United States Patent [19]

McIlvaine

[11] Patent Number: 4,993,940

[45] Date of Patent: Feb. 19, 1991

[54] SCRAPPER FOR AN AXIAL SEAL IN A ROTARY COMBUSTOR

[75] Inventor: Scott E. McIlvaine, Acme, Pa.

[73] Assignee: Westinghouse Electric Corp., Pittsburgh, Pa.

[21] Appl. No.: 534,602

[22] Filed: Jun. 6, 1990

[51] Int. Cl.[5] ..... F27B 7/24

[52] U.S. Cl. ..... 432/105; 432/115; 432/242; 110/246

[58] Field of Search ..... 432/105, 75, 115, 242; 110/246

[56] References Cited

U.S. PATENT DOCUMENTS

| | | | |
|---|---|---|---|
| 4,295,824 | 10/1981 | Wens | 432/242 |
| 4,457,520 | 7/1984 | Graachtrup | 432/242 |
| 4,728,289 | 3/1988 | Samera, Jr. | 432/115 |

*Primary Examiner*—Henry C. Yuen

*Attorney, Agent, or Firm*—Fred J. Baehr, Jr.

[57] ABSTRACT

A scraper for an axial seal on a rotary combustor of a municipal solid waste incinerator comprising a plurality of short scraper blades having a tapered leading cutting edge attached to alternating radially disposed seal support bars attached to combustor tubes to remove aluminum and other built up material from axial seal shoes to extend the effective life of the axial seals.

5 Claims, 4 Drawing Sheets

SCRAPPER FOR AN AXIAL SEAL IN A ROTARY COMBUSTOR

CROSS REFERENCE TO RELATED APPLICATIONS

This application is related to an allowed application entitled "Replaceable Longitudinal Seal for a Rotary Combustor" Ser. No. 437969, filed Nov. 16, 1989 and assigned to the same assignee.

BACKGROUND OF THE INVENTION

The invention relates to a municipal solid waste incinerator and more particularly to a scraper for the axial seal on the rotary combustor utilized therein.

A rotary combustor, as described in the above noted related application, is formed from a circular array of pipes separated by perforated webs and has axial or longitudinal seals which comprise a flat bar extending radially outwardly from ever other pipe with an angle bracket positioned on and welded to each flat bar so as to compensate for out of roundness of the combustor, a plurality of thin resilient strips of stainless steel removably fastened to each angle bracket and extending outwardly from the flat bar at an angle of approximately 60° and a plurality of arcuate shoes disposed proximate a circle scribed by the distal margins of the thin strips to form a dependable seal, which will deflect when encountering debris on the shoes and portions thereof can be easily replaced if damaged by the debris.

SUMMARY OF THE INVENTION

Among the objects of the invention may be noted the provision of a scrapper, which will remove the debris including solidified aluminum to prevent damage to the longitudinal seal strips.

In general, a scrapper for removing aluminum and other materials from axial seals in an incinerator having a rotary combustor formed from a circular array of cooling tubes spaced apart by a perforated web, wherein the axial seal includes a plurality of support bars affixed to ever other tube and extending radially outward therefrom, sealing strips extending at an angle from said support bars and a stationary shoe disposed adjacent a distal end of the support bars to form an axial seal as the sealing strips approach the shoe, when made in accordance with this invention, comprises a plurality of radial members attached to the support bars. The radial members each have a radially outer distal margin with a wedged shaped portion that increases in thickness from one end of the radial member to the other. The wedge portion extending over about one half the radial height of the radial member. A flat portion is disposed radially inward of the wedge shaped portion and a plurality of kerfs extending inwardly from the distal margin and beyond the wedged portion and into the flat portion to form a plurality of wedge shaped fingers of increasing thickness so that as the rotary combustor turns the thickest edge of one finger contacts aluminum and other material built up on the stationary shoe allowing each finger to scrape a discreet portion of the shoe and remove the aluminum and other material to prevent damage to the sealing strips so the axial seal is maintained.

BRIEF DESCRIPTION OF THE DRAWINGS

The invention as set forth in the claims will become more apparent by reading the following detailed description in conjunction with the accompanying drawings, wherein like reference numerals refer to like parts throughout the drawings and in which:

DESCRIPTION OF THE PREFERRED EMBODIMENT

Figure 1:
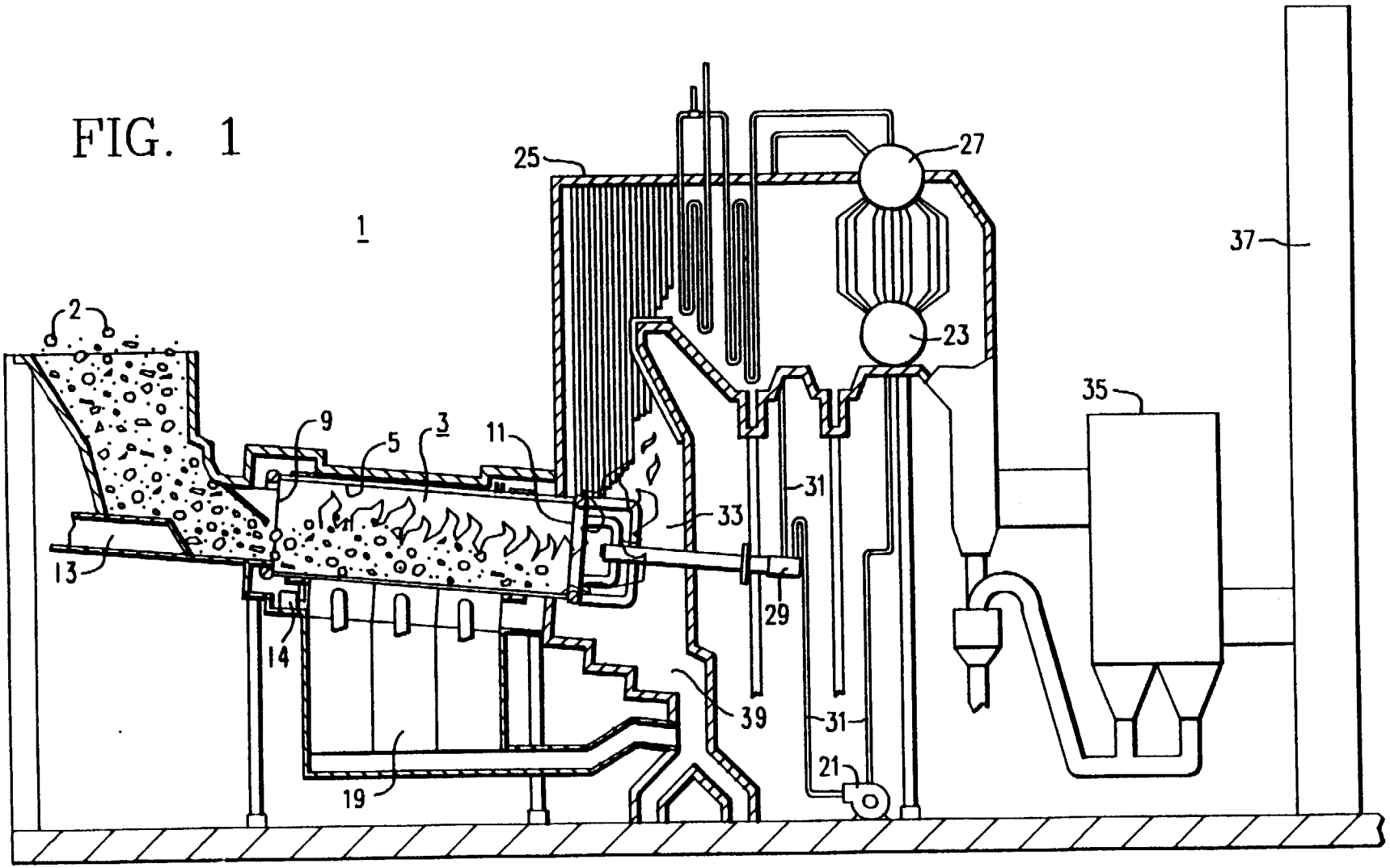
FIG. 1 is a schematic partial sectional view of a municipal solid waste incinerator.
Figure 2:
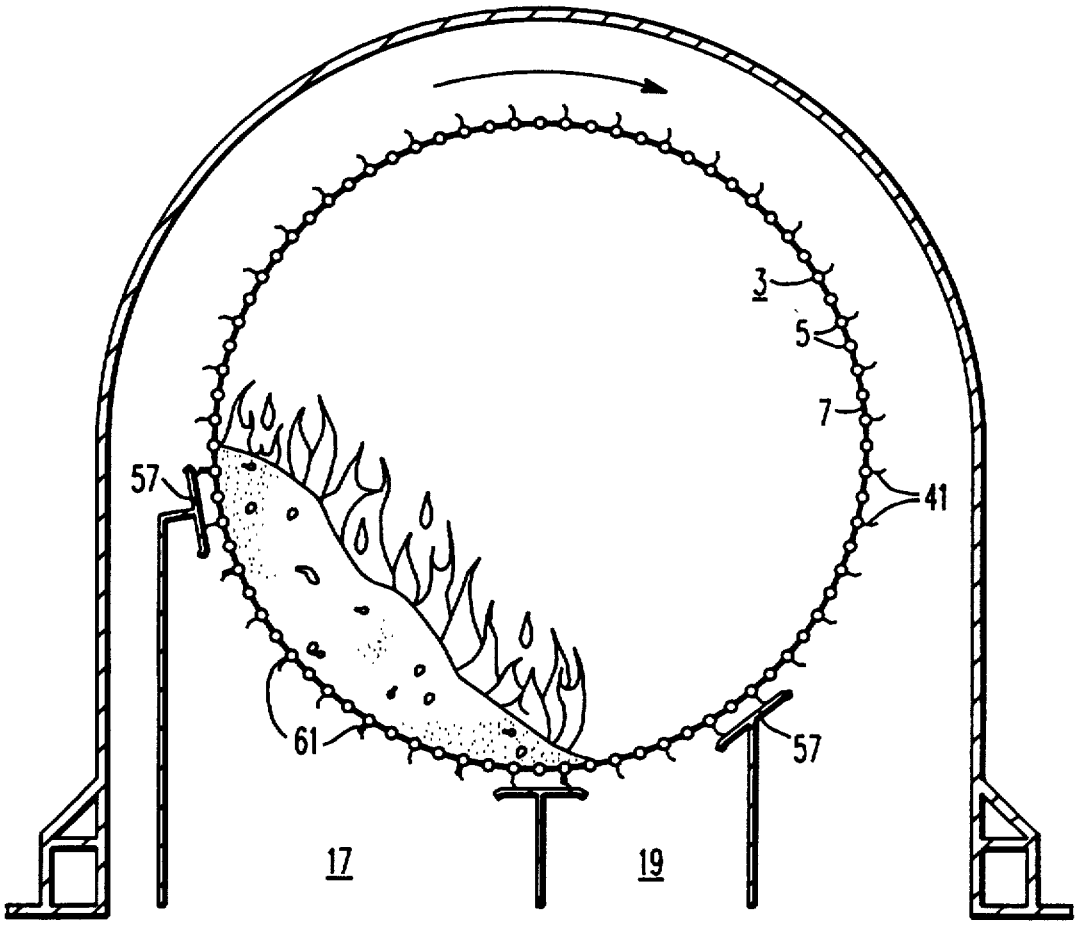
FIG. 2 is a enlarged partial sectional view of a rotary combustor with the invention shown thereon.

Referring now to the drawings in detail and in particular to FIG. 1 there is shown an incinerator 1 for burning municipal solid waste 2 in a rotary combustor 3. The rotary combustor 3 is formed from a circular array of tubes or pipes 5 with a plate or web 7 connecting adjacent pipes 5. The rotary combustor 3 is disposed to rotate on an inclined axis. Waste to be incinerated is fed into an upper or inlet end 9 of the combustor 3 by a ram 13 and tumbles toward a lower or outlet end 11 as the combustor 3 rotates on metal tires, which engage spaced apart rollers (not shown) by a drive mechanism 14. The plates or webs 7 are perforated to provide holes or perforations 15 which allow combustion air supplied from plenum chambers 17 and 19 to enter the bottom portion of the rotary combustor 3. The burning tumbling waste 2, as shown in FIG. 2 tends to ride up on one side of the combustor 3 as it rotates and the plenum chamber 17 there under is disposed to supply combustion air to the underside of the burning waste and is thus called the underfire plenum chamber 17 and the adjacent plenum chamber 19 is disposed to supply combustion air over the burning waste and is thus called the overfire plenum chamber 19.

A cooling fluid, water, is circulated through the pipes 5 to keep them and the webs 7 cool and increase their useful life. The water is supplied from a pump 21, which takes its suction from a water drum 23 in a waste heat water wall boiler 25 and returns the heated cooling fluid to a steam drum 27 via a rotary joint 29 and associated piping 31. Unburnables, ash and hot gases exit from the lower end of the combustor 3, the hot gases and some fly ash flow upwardly in a flue portion 33 of the boiler 25, through a filter 35, such as a electrostatic precipitator or other filtering means, which removes the fly ash and then out a stack 37. The heavier ash and unburnables fall into the an ash removal hopper 39 in the bottom portion of the boiler 25.

Figure 3:
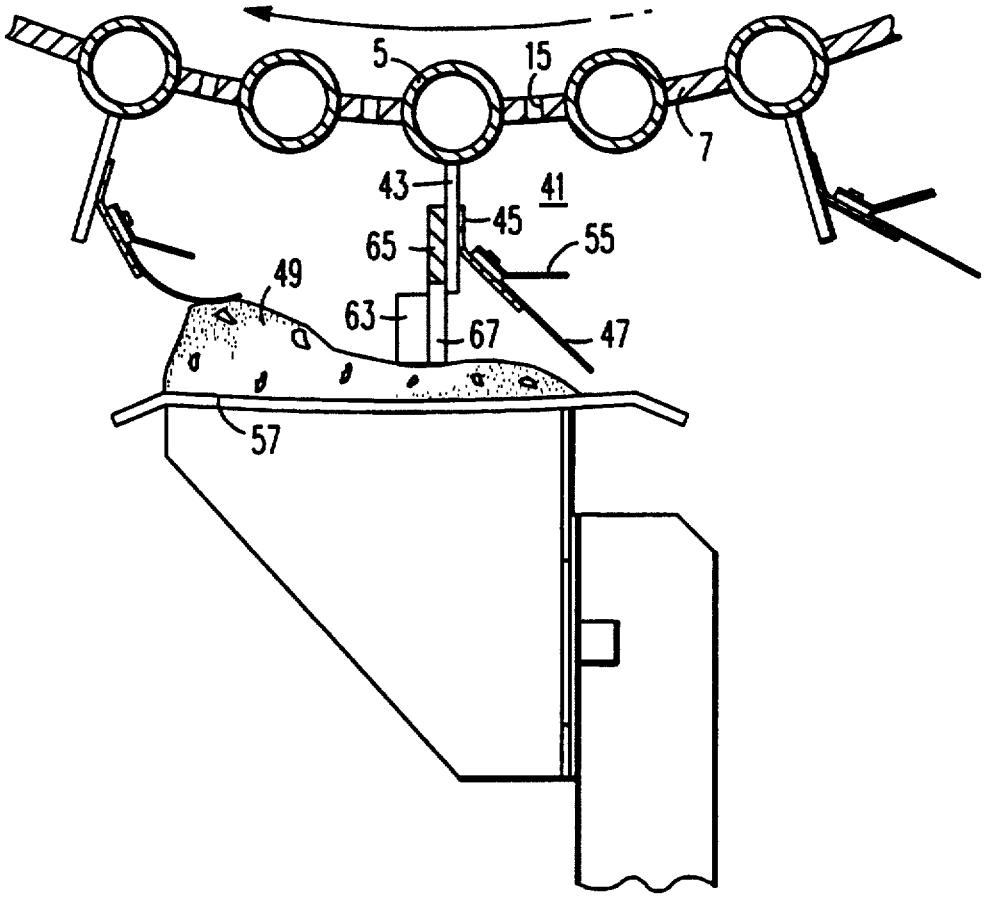
FIG. 3 is an enlarged partial sectional view showing the axial seal and scrapper in more detail.
Figure 4:
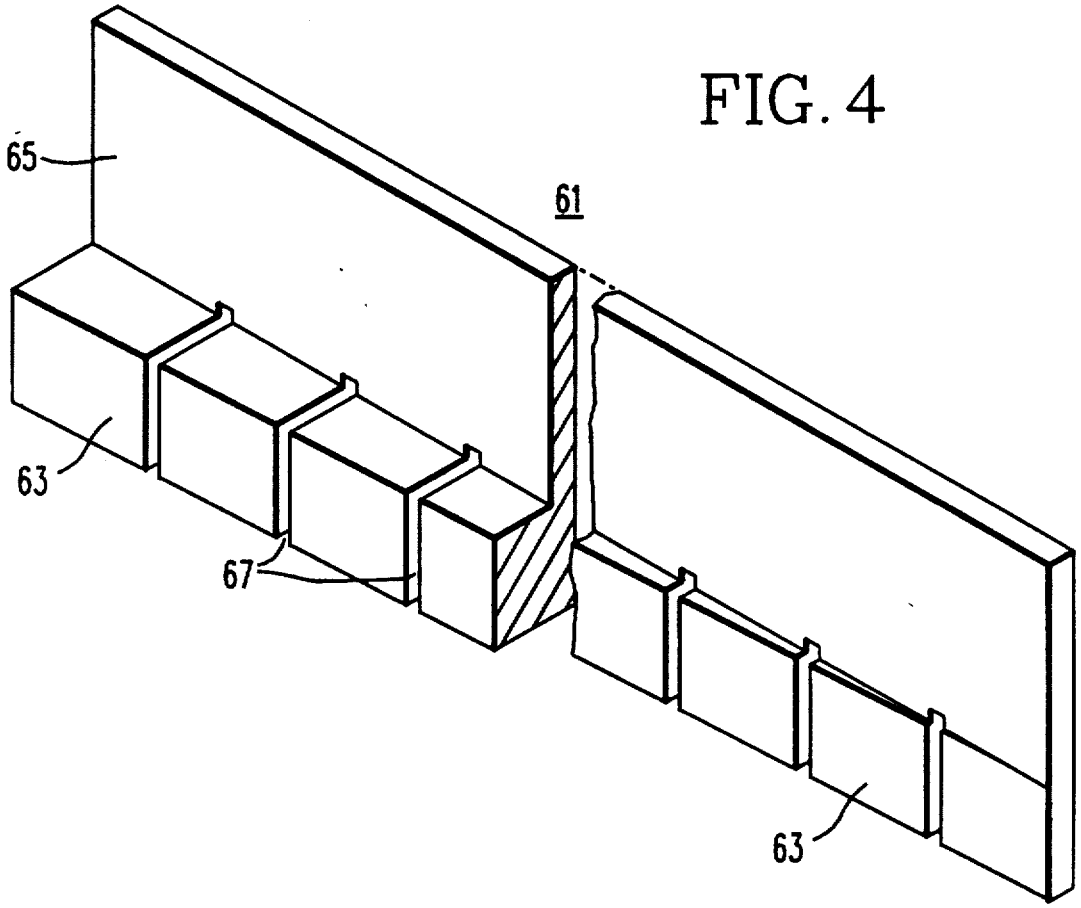
FIG. 4 is a isometric view of a radial member forming a scrapper.

To provide efficient burning of the waste irrespective of it varying heat and moisture content, the underfire and overfire combustion air are controlled separately, thus requiring that a dependable axial or longitudinal seals 41 be disposed at the junctures of the plenum chambers 17 and 19 and the rotary combustor 3. The longitudinal seals 41, as shown in FIG. 3, comprise a flat plate or support bar 43 affixed longitudinally along the length of every other pipe 5 so as to extend radially outward therefrom and an angle bracket 45 is affixed to the support bar 43 by welding. The bracket 45 is positioned on the flat plate 43 and moved radially inwardly or radially outwardly prior to welding to compensate for out of roundness of the rotary combustor 3. A thin strip 47 made of stainless steel or other resilient heat resistant material is replaceably fastened to the angle bracket 45 so as to extend from the support bar 43 at an angle. A radiation shield 55 is fastened on the radial inner side of the angle bracket 45 to shield the thin strips 47 from radiant energy produced by the burning waste 2 and passing through the perforations 15 in the adjacent web 7 to prevent local heat induced distortion in the thin strips 47 opposite the perforations 15. A plurality of arcuate shaped shoes 57 are disposed longitudinally adjacent the rotary combustor 3. The thin strips 47 are disposed to scribe a circle proximate the shoes 57 just clearing them to form a reliable rotatable longitudinal seal 41 adjacent the rotary combustor 3. The width of the shoes 57 is sufficient so that the margin of an adjacent strip 47 is proximate the shoe 57 prior to the margin of the thin strip proximate the shoe 57 moving away therefrom.

The strips 47, as shown in FIG. 3, are resilient or spring like so that they will resiliently bend and pass over debris and obstructions such as solidified aluminum drips 59, which adhere to the shoes 57. If the aluminum is allowed to build up for extended periods of time, the amount of build up becomes substantial and cause damaged to the thin strips 47. To prevent this scrappers are installed to shave the aluminum and other material 59 from the shoe 57.

Figure 5:
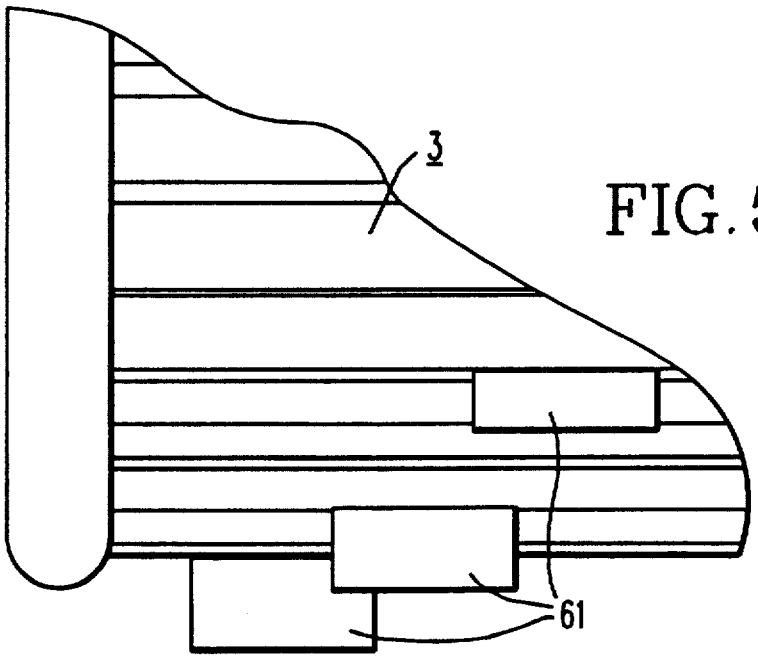
FIG. 5 is a partial elevational view of the scraper disposed on the rotary combustor.

The scrapper comprises a plurality of scraper blades or radial members 61 attached to the support bars 43. Each radial member 61 has a radially outer distal margin with a wedge shaped portion 63 that increases in thickness from one end of the radial member 61 to the other. The wedge shaped portion 63 extends over about one half of the radial height of the radial member 61. A flat plate like portion 65 is disposed radially inwardly of the wedge shaped portion 63. A plurality of kerfs 67 extend inwardly from the distal margin of the wedge shaped portion 63 beyond the wedge shaped portion 63 and into the flat portion 65 forming a plurality of wedge shaped fingers 69 of increasing thickness. Thus, as the rotary combustor 3 rotates the thickest edge of the thickest finger 69 makes contact with the built up aluminum or other material 59 shaving it from the shoe 57 allowing each finger 69 in turn to remove the aluminum or other built up material 59 from a discrete portion of the shoe 57. The radial members 61 are attached to every other support bar 43 so that only one radial member 61 is in contact with the built up material 59 at any particular time in order to keep the load on the drive mechanism 14 at a minimum. The radial members 61, as shown in FIG. 5, are so disposed so that their ends overlap, whereby the entire shoe 57 is scrapped. The thickness of the flat portion 65 and the spacing and depth of the kerfs 67 cooperate to allow the fingers 69 to bend rather than cause damage to the support bar 43 or shoe 57 if a finger 69 encounters a bolt or other debris, which may tend to jam between the finger 69 and shoe 57.

The scrapper described herein advantageously removes the aluminum or other built up material by breaking the bond between the material 59 and the shoe 57 or machines the aluminum or built up material 59 providing a smooth surface for the seal strip 47 to prolong it useful life and since only one scraper radial member 61 contacts a shoe 57 at a given time and the leading edge is tapered so that the load on the combustor drive mechanism 14 is held to a minimum.

While the preferred embodiments described herein set forth the best mode to practice this invention presently contemplated by the inventor, numerous modifications and adaptations of this invention will be apparent to others skilled in the art. Therefore, the embodiments are to be considered as illustrative and exemplary and it is understood that the claims are intended to cover such modifications and adaptations as they are considered to be within the spirit and scope of this invention.

What is claimed is:

1. A scrapper for removing aluminum and other materials from axial seals in an incinerator having a rotary combustor formed from a circular array of cooling tubes spaced apart by a perforated web, wherein the axial seal includes a plurality of support bars affixed to every other tube and extending radially outward therefrom, sealing strips extending at an angle from said support bars and stationary shoes disposed adjacent a distal end of the support bars to form an axial seal as the sealing strips approach the shoes; the scrapper comprising a plurality of radial members attached to the support bars; the radial members each having a radially outer distal margin with a wedged shaped portion that increases in thickness from one end of the radial member to the other; the wedge portion extending over about one half the radial height of the radial member; a flat portion disposed radially inward of the wedge portion and a plurality of kerfs extending inwardly from the distal margin and beyond the wedged portion to form a plurality of wedge shaped fingers of increasing thickness so that as the rotary combustor turns the thickest edge of one finger makes the first contact with the aluminum and other material built up on the stationary shoe allowing each finger to scrape a discreet portion of the shoe and remove the aluminum and other material to prevent damage to the sealing strips so as to maintain an effective seal.

2. The scrapper of claim 1, wherein adjacent radial members are attached to support bars so as to skip adjacent support bars.

3. The scrapper of claim 2, wherein adjacent radial members are so disposed that their ends overlap one another.

4. The scrapper of claim 1, wherein the spacing and depth of the kerfs and the thickness of the flat portion cooperate so that the fingers bend rather than damage the shoe or support bar.

5. The scrapper of claim 1, wherein the overall length of each radial member is such that when encountering aluminum and other materials built up on the shoe a drive mechanism that rotates the rotary combustor will not be overloaded.

* * * * *